US007086472B1

(12) United States Patent
Incoronato

(10) Patent No.: US 7,086,472 B1
(45) Date of Patent: Aug. 8, 2006

(54) DEVICE AND METHOD OF COLLECTING SOLIDS FROM A WELL

(76) Inventor: Arne Incoronato, Snodeveien 13, N-4056, Tananger (NO)

( * ) Notice: Subject to any disclaimer, the term of this patent is extended or adjusted under 35 U.S.C. 154(b) by 0 days.

(21) Appl. No.: 11/102,468

(22) Filed: Apr. 8, 2005

(51) Int. Cl.
*E21B 29/12* (2006.01)

(52) U.S. Cl. ..... 166/357; 175/7; 175/207; 405/210

(58) Field of Classification Search ..... 166/356, 166/357; 405/128, 210; 175/7, 66, 206, 175/207
See application file for complete search history.

(56) References Cited

U.S. PATENT DOCUMENTS

| | | | | |
|---|---|---|---|---|
| 3,643,447 A | | 2/1972 | Pogonowski | |
| 4,030,216 A | * | 6/1977 | Willums | 37/320 |
| 5,820,300 A | * | 10/1998 | Sonoda et al. | 405/188 |
| 5,878,814 A | * | 3/1999 | Breivik et al. | 166/267 |
| 5,899,637 A | * | 5/1999 | Blanchard et al. | 405/210 |
| 6,062,313 A | * | 5/2000 | Moore | 166/357 |
| 6,276,455 B1 | * | 8/2001 | Gonzalez | 166/357 |
| 6,718,900 B1 | * | 4/2004 | Carter | 114/257 |

FOREIGN PATENT DOCUMENTS

| | | | |
|---|---|---|---|
| GB | 2 350 326 | | 11/2000 |
| NO | 173521 | | 9/1990 |
| NO | 308043 | | 5/1998 |
| WO | WO 99/46474 | | 9/1999 |
| WO | WO 01/18352 | * | 3/2001 |

* cited by examiner

*Primary Examiner*—Thomas B. Will
*Assistant Examiner*—Toni Newville
(74) *Attorney, Agent, or Firm*—Knobbe Martens Olson & Bear LLP

(57) ABSTRACT

Exemplary embodiments include a method and a device for temporary storage of solid particles such as drill cuttings from a hole section for surface casing in a wellbore. In certain embodiments, the device having at least one collecting device placed on the seabed near a template over the mouth of a well. When the receptacle element in the collecting device is to be emptied, the collecting device is brought up to and on board a vessel on the surface of the sea.

2 Claims, 1 Drawing Sheet

DEVICE AND METHOD OF COLLECTING SOLIDS FROM A WELL

BACKGROUND

1. Field of the Invention

This invention regards a method of and device for collecting solids from a well, more particularly drill cuttings from the hole section for surface casing in a petroleum well.

2. Description of the Related Technology

When drilling petroleum wells large amounts of drill cuttings are generated, which consist of among other things particles from the formation being drilled. Today it is required that drill cuttings from the wellbore in the hole section for surface casing be brought to the surface and transported to shore for further processing. Drill cuttings generated by the drilling after the hole section for surface casing has been completed, are brought up to the surface by a return riser for drill cuttings and drilling fluid. On the drilling vessel, the drilling fluid is filtered from the drill cuttings, which are then transported to shore for further processing and disposal.

When drilling the hole section for surface casing it is not possible to use a riser that allows the drill cuttings to be transported directly to the drilling vessel on the surface. As the hole section for surface casing is only a small part of a wellbore, it has been deemed acceptable for drill cutting from this section to be disposed on the seabed near the wellbore. However, the requirements to be met in connection with drilling discharges are becoming stricter. In some geographical areas it is required that drill cuttings from the hole section for surface casing also be brought to the surface and transported to further processing on shore, on the same level as drill cuttings from lower hole sections.

SUMMARY OF THE INVENTION

The following describes non-limiting examples of preferred embodiments illustrated in the accompanying drawing. The system, method, and devices of the invention each have several aspects, no single one of which is solely responsible for its desirable attributes. Without limiting the scope of this invention, its more prominent features will now be discussed briefly. After considering this discussion, and particularly after reading the section entitled "Detailed Description of the Preferred Embodiments" one will understand the advantages of the invention. The object of the invention is to provide a device that makes it possible to collect solids, in particular drill cuttings, which result from the drilling of an oil well, so as to allow the drill cuttings to be brought to a surface vessel in order then to be transported to further processing or disposal on shore.

In certain embodiments, a method comprises placing a collecting device on a seabed near a template over the mouth of a well, leading drill cuttings from the template over the mouth of the well into the collecting device, transporting the collecting device containing drill cuttings from the seabed up to and on board a vessel on the surface of the sea, and transporting the drill cuttings on board the vessel on to further processing.

In certain embodiments, a method removes watery drill cuttings returned from a hole section for surface casing in a wellbore. The method comprises placing a collecting device having a receptacle element on a seabed near a template arranged over a mouth of a well, wherein the receptacle element has one or more draining wall portions, pumping drill cuttings and water from the template into the receptacle element, wherein liquid displaced when the drill cuttings are fed into the receptacle is drained out through the one or more draining wall portions, raising the collecting device from the seabed, draining a substantial portion of the water from the receptacle element as the receptacle element is brought on board a vessel from a surface of a sea, and transporting the drill cuttings for further processing.

In certain embodiments, a method removes watery drill cuttings returned from a hole section for surface casing in a wellbore. The method comprises collecting watery drill cuttings from a hole section for surface casing in a wellbore and into a device having drainage capacity and transporting the device containing the watery drill cuttings between a seabed and a vessel so that a portion of water drains through the device.

In certain embodiments, a collecting device is configured to receive watery drill cuttings pumped from a hole section for surface casing in a wellbore. The collecting device comprises a receptacle element having at least one wall element and being configured to be brought up to a surface and on board a vessel on the surface, wherein at least one portion of the at least one wall element of the receptacle element has drainage property.

At least one collecting device collects drill cuttings from the hole section for surface casing in a wellbore and transports the collecting device containing drill cuttings from the seabed up to and on board a vessel.

DETAILED DESCRIPTION OF THE PREFERRED EMBODIMENTS

Figure 1:
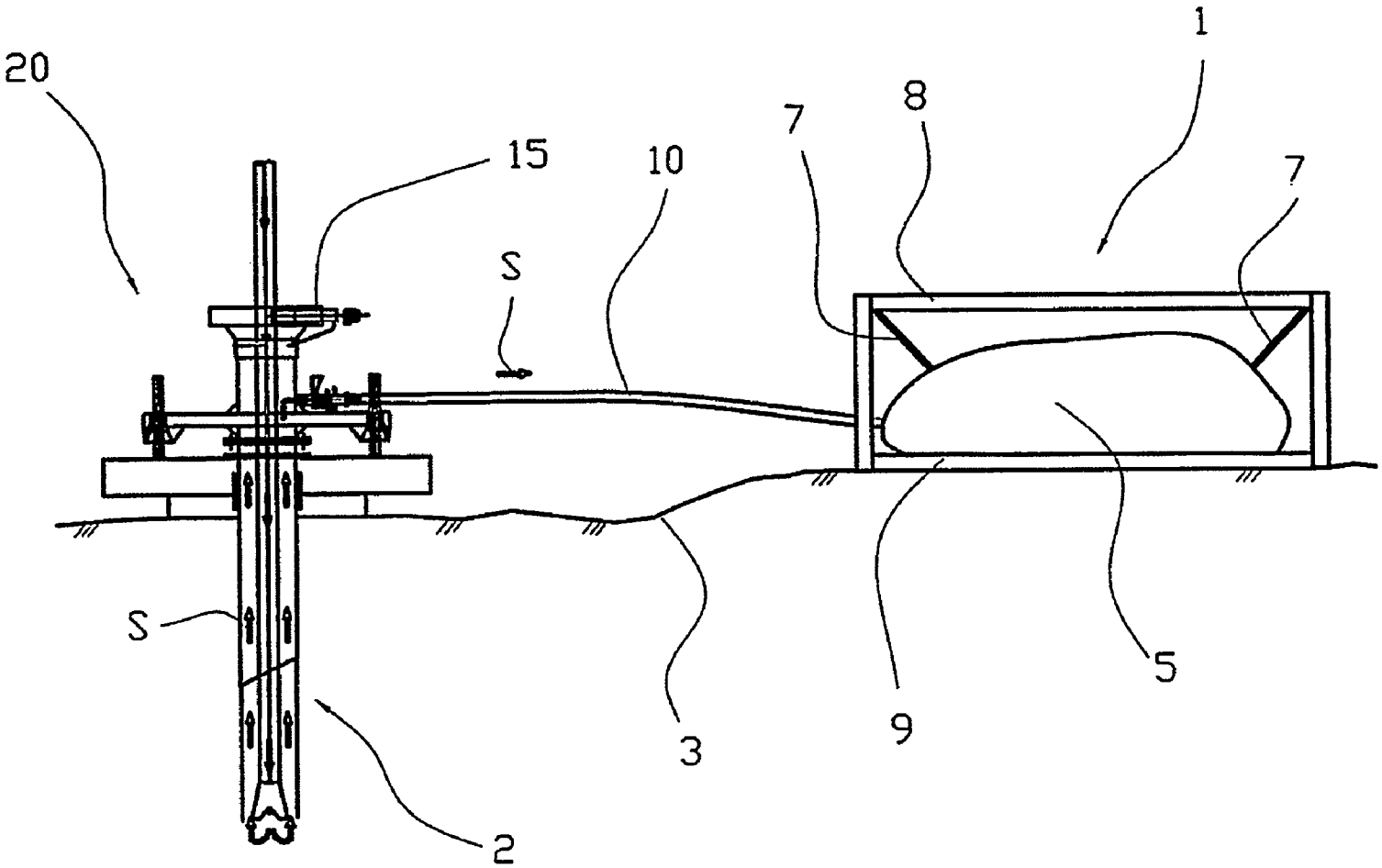
FIG. 1 is a perspective view of a collecting device in accordance with the invention, where the collecting device is made up of a flexible receptacle element arranged in a frame.

The terms vertical and horizontal orientations refer to the position of use for the collecting device in accordance with the drawing. The term vessel, as used herein, denotes any type of facility that floats on the surface of the sea.

A method used for transporting drill cuttings from the hole section for surface casing in a petroleum well to the surface is to suck the drill cuttings up from the seabed to a surface vessel as the drill cuttings are brought up to the sea bed from the well bore. Sucking drill cuttings up from the seabed in this manner also involves sucking up large quantities of water. In some geographical areas return of this water to the sea is permitted, and so it is only the drill cuttings that need to be transported to shore for further processing.

However, in some environmentally sensitive areas the return to sea of uncleaned water from the process of sucking up drill cuttings from the hole section for surface casing is not permitted. This means that large quantities of water must either be cleaned on the surface vessel or be brought to shore for cleaning. Placing a large-scale treatment plant on a drilling vessel for cleaning up the water from this process is normally out of the question due to the limited space available.

An object of the invention is to remedy or at least reduce one or more of these disadvantages. Another object is achieved by the characteristics given in the description below and in the following claims.

At least one collecting device is arranged near the mouth of a well on the seabed, the collecting device in certain embodiments has a receptacle-like and preferably completely or partially water permeable element into which the drill cuttings from the hole section for surface casing in the well are brought by means of a pump and feed line. The pump and feed line interconnect between a device over the mouth of the well and the collecting device in a known manner. The water that comes into the receptacle-like element together with the drill cuttings when these are pumped or otherwise transported from the mouth of the well to the receptacle-like element. The water is forced out through the water permeable portions of the receptacle element as the receptacle-like element is filled with solids such as drill cuttings.

In certain embodiments, the receptacle element is defined by at least one element having a rigid or flexible wall element or a combination thereof. Furthermore the at least one wall element may be manufactured from a completely or partially water permeable material. In certain embodiments, the at least one wall element is manufactured from one or more portions of the wall element and may be impermeable while one or more portions of the wall element may have openings that allow the water to flow out of the receptacle element.

When filled with drill cuttings the receptacle is brought to a vessel on the surface by means of a device. Exemplary devices include a hoisting device or the like. The vessel transports the drill cuttings to shore or other suitable location for further processing.

Advantageously, in order to avoid having to interrupt the drilling process when, for example, the receptacle-like element has been filled with drill cuttings and is being brought up to the vessel and possibly to shore for further processing, a second receptacle may be arranged by the mouth of the well and connected to the feed line and pumping means to continue receiving the drill cuttings. After filling up the first receptacle with drill cuttings, the second receptacle may then be filled. Of course additional receptacles may be used. In certain embodiments, two or more receptacles are filled simultaneously.

Experiments with a type of receptacle having highly water permeably wall elements have shown that more than 80% of the drill cuttings from the hole section for surface casing in the borehole are brought to the surface. When using a type of receptacle in which only a limited portion of the receptacle wall element has openings that allow water to flow out, the proportion of drill cuttings from the hole section for surface casing that can be brought up to and on board the vessel is even higher. The reason for this is that a more impermeable receptacle will limit the washing away of finer particles of drill cuttings when the receptacle is raised from the seabed to the vessel as compared to a receptacle that has a more open wall element.

In the drawings, reference number 1 denotes an embodiment of a collecting device. In the illustrated embodiment, the collecting device 1 is made up of a receptacle element 5 that is suitable for holding drill cuttings that exit the wellbore 2 and enter the receptacle element 5 by means of a pump 15 and a pipe or hose 10. In the illustrated embodiment, the pump 15 is fixed on a template 20 over the wellbore 2. The direction of flow of the drill cuttings in the wellbore and in the line 10 is indicated by arrows S.

In certain embodiments, the receptacle element 5 is made from a flexible material arranged in a frame 8. The frame 8 may be made from a rigid material suitable for supporting the receptacle element 5 when the receptacle element 5 is filled with drill cuttings and is being brought on board a vessel (not shown) on the surface of the sea. The collecting device 1 is placed on a seabed 3 near the template 20 over the mouth of the well. In certain embodiments, the frame 8 may be provided with wall portions so as to form a container as known by one having ordinary skill in the art.

In certain embodiments, the flexible material making up the receptacle element 5 is manufactured by, for example, weaving or knitting fibres of a suitable material in a way that is known by one having ordinary skill in the art. In certain embodiments, the receptacle element comprises a fine-meshed seine-like bag.

In certain embodiments, the base 9 of the frame 8 is provided with a covering plate member. The covering plate member may be rigidly mounted to the frame 8 in order to prop up the receptacle element 5. In certain embodiments, the plate member comprises a plurality of cutouts to aid drainage during raising and lowering of the collecting device 1. In certain other embodiments, the receptacle element 5 can be supported by a grating of a type that is known by one having ordinary skill in the art.

In FIG. 1 the upper portion of the receptacle element 5 is shored up by one or more straps 7 (two shown in the exemplary embodiment) attached to the receptacle element 5 and the frame 8. The straps 7 ensure that a receptacle element 5 filled with drill cuttings can not be displaced out of the frame upon transfer between the seabed 3 and the vessel on the surface of the sea. In certain embodiments, the bottom of the receptacle element 5 is attached to the plate member or grating.

In certain embodiments, the frame 8 comprises lateral face members (not shown) where at least one side is made from a grid-like material that allows water to percolate out. In this embodiment, the flexible receptacle element 5 shown in FIG. 1 may be replaced with a frame 8 having lateral faces.

In certain embodiments, the receptacle element 5 is made from a rigid material, for example, steel and the like, that provides an inlet for connecting to the feed line 10 and at least one outlet. It has been found that maximizing the distance between the inlet and outlet increases settling of particles in the receptacle before the water is forced out. In order to facilitate drainage of the water present with the drill cuttings in the receptacle before the receptacle is brought onboard; in certain embodiments the receptacle comprises one or more drainage outlets. In certain embodiments, the one or more drainage outlets are located in the lower portions of the receptacle element. In certain embodiments, opening and closing of the drainage outlet is controlled.

While the above detailed description has shown, described, and pointed out novel features of the invention as applied to various embodiments, it will be understood that various omissions, substitutions, and changes in the form and details of the device or process illustrated may be made by those skilled in the art without departing from the spirit of the invention. As will be recognized, the present invention may be embodied within a form that does not provide all of the features and benefits set forth herein, as some features may be used or practiced separately from others.

What is claimed is:

1. A method of removing watery drill cuttings returned from a hole section for surface casing in a wellbore, the method comprising:

placing a collecting device having a receptacle element on a seabed near a template arranged over a mouth of a well, wherein the receptacle element has one or more permeable draining wall portions;

pumping drill cuttings and water from the template into the receptacle element, wherein liquid displaced when the drill cuttings are fed into the receptacle is drained out through the one or more permeable draining wall portions;

raising the collecting device from the seabed;

draining a substantial portion of the water from the receptacle element through said permeable draining wall portions as the receptacle element is brought on board a vessel from a surface of a sea; and transporting the drill cuttings for further processing.

2. A method according to claim 1, wherein the collecting device is raised from the seabed by means of a hoisting device.

* * * * *